United States Patent [19]

Maginot et al.

[11] 4,180,983

[45] Jan. 1, 1980

[54] DEVICE FOR PREVENTING LEAKAGES OF WORKING FLUID FROM A HEAT ENGINE

[75] Inventors: Pierre Maginot, Paris; Roger Le Peutrec, Chatenay Malabry, both of France

[73] Assignee: Alsthom-Atlantique, Paris, France

[21] Appl. No.: 895,178

[22] Filed: Apr. 10, 1978

[30] Foreign Application Priority Data

Apr. 12, 1977 [FR] France ..... 77 10889

[51] Int. Cl.[2] ..... F01K 25/08; F01K 11/00

[52] U.S. Cl. ..... 60/657; 60/671; 60/669

[58] Field of Search ..... 60/646, 651, 657, 671, 60/669

[56] References Cited

U.S. PATENT DOCUMENTS

| | | | |
|---|---|---|---|
| 3,831,381 | 8/1974 | Swearingen | 60/657 |
| 4,005,580 | 2/1977 | Swearingen | 60/657 |

*Primary Examiner*—Allen M. Ostrager

*Attorney, Agent, or Firm*—Sughrue, Rothwell, Mion, Zinn and Macpeak

[57] ABSTRACT

The invention comes within the field of heat engines which operate by means of a fluid which flows in a closed circuit. A device characterized by the fact that the engine is placed in a sealed chamber and that its output shaft is coupled to a transmission shaft which does not undergo any bending stress, having a seal where the transmission shaft passes through the chamber, the seal being permanently in contact with a lubricant during operation and when the engine is stopped. The invention applies in particular to isolated low or medium power engine installations which require only slight supervision.

2 Claims, 2 Drawing Figures

DEVICE FOR PREVENTING LEAKAGES OF WORKING FLUID FROM A HEAT ENGINE

FIELD OF THE INVENTION

The present invention relates to a device for preventing leakages of a working fluid from a heat engine which operates by means of the internal energy of the fluid and which operates in a closed cycle.

BACKGROUND OF THE INVENTION

In the transformation, in a closed cycle, of the energy of a gas or of steam under pressure into mechanical energy, it is necessary for the output shafts of the engine and of the accessories which convey the gas or the steam thereto to be hermetically sealed. In a known manner, imperfect sealing is provided by rotating seals, whether fed with a liquid lubricant or not, which limit leakage of the fluid conveyed and of the liquid lubricant if any, towards the outside.

This is the case, for example when the fluid is air or steam and the liquid lubricant, if it exists, is oil. There can even be no seal ring if some discharge of leakage fluid can be accepted.

However, this is not suitable for closed cycle operation when there must be no leakage. This is the case for example if an expensive or harmful working fluid such as "Freon" (registered trademark) is used, or if the installation is isolated without frequent supervision for an operator to make up for leakages by additions. All leakages could be perfectly avoided by transmitting the engine torque by means of a magnetic drive, in which case the output shaft of the engine would include a magnetic plate which would be separated from a second plate, which is integral with a driven shaft, by a fluid-tight wall which surrounds the engine or is hermetically fixed to the engine. However, such a solution is very cumbersome and very expensive and in any case, it cannot be justified at low power.

SUMMARY OF THE INVENTION

The present invention aims to mitigate these disadvantages and provides a device for preventing leakage of a working fluid from an engine which operates by means of internal energy of the fluid and which operates in a closed cycle, characterized in that the engine is placed inside a fixed and sealed chamber with its output shaft turned vertically downwards and in that it also includes a transmission shaft aligned with said engine output shaft and coupled to said output shaft by means of a coupling which allows some radial and axial play, said transmission shaft passing through said chamber, being fixed and supported by a lower bearing which axially fixes the transmission shaft and by an upper bearing which allows a free axial expansion, and having a rotating seal ring in the vicinity of the bearing which fixes the shaft axially and co-operates with a fixed seal ring which is integral with said chamber, said seals being lubricated by means of a lubricant contained in the lower part of said chamber, lubricant supply orifices for said seals being provided in a support bushing for the seals and the bearings at a higher level than that of the bottom of the chamber, said lubricant being kept, by heating means, at a temperature which allows the evaporation of said fluid which is contained in the lubricant.

Thus, in accordance with the invention, the seal ring operates in good conditions, since it is situated at the level of the transmission shaft which, due to its coupling which allows a small radial play, is not subjected to bending stresses; the fixed seal and the rotating seal therefore effectively operate in a flat position against each other. Since the transmission shaft is not subjected to any bending stresses but only to torsional stresses, it can have a smaller diameter than that of the output shaft of the engine which is subjected to both torsional and bending stresses and its diameter is calculated for the maximum torque; the leakage path of the seal is therefore also smaller than it would be if it were placed on the output shaft of the engine. The fact that the seal rings are also situated in the vicinity of the bearing which axially fixes the shaft, for example a ball bearing, also enables the seals to operate in good conditions.

Lastly, the seals are in contact only with the lubricant or with the lubricant and a very small quantity of working fluid dissolved in the lubricant, but never with the working fluid alone, whether condensed or in a gaseous form: therefore, firstly, the seals are always well-lubricated and secondly no working fluid is lost except for the part dissolved in the lubricant which is very small due to the heating system which makes it possible to evaporate at any time the fluid dissolved in the lubricant or condensed and situated at the base of the tank below the level of the lubrication orifices of the seals.

Other advantages and characteristics of the present invention will become apparent from the description of a non-limiting example of the invention given hereinbelow with reference to the accompanying drawings.

DESCRIPTION OF A PREFERRED EMBODIMENT

Figure 1:
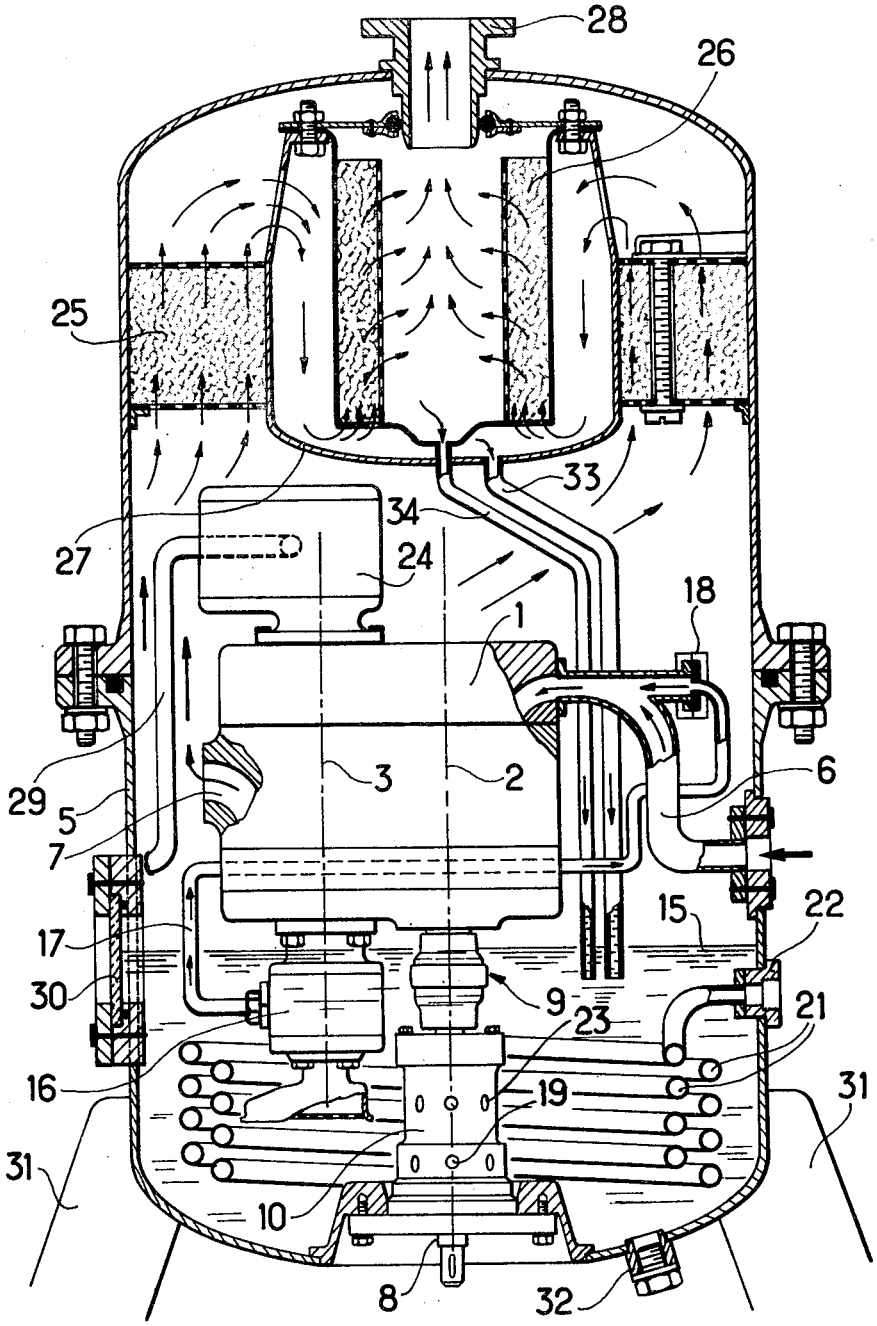
FIG. 1 shows an assembly which is intended to transform the energy contained in the vapour of an organic fluid such as that known by the trade mark "Freon", for example by means of a Rankine cycle.
Figure 2:
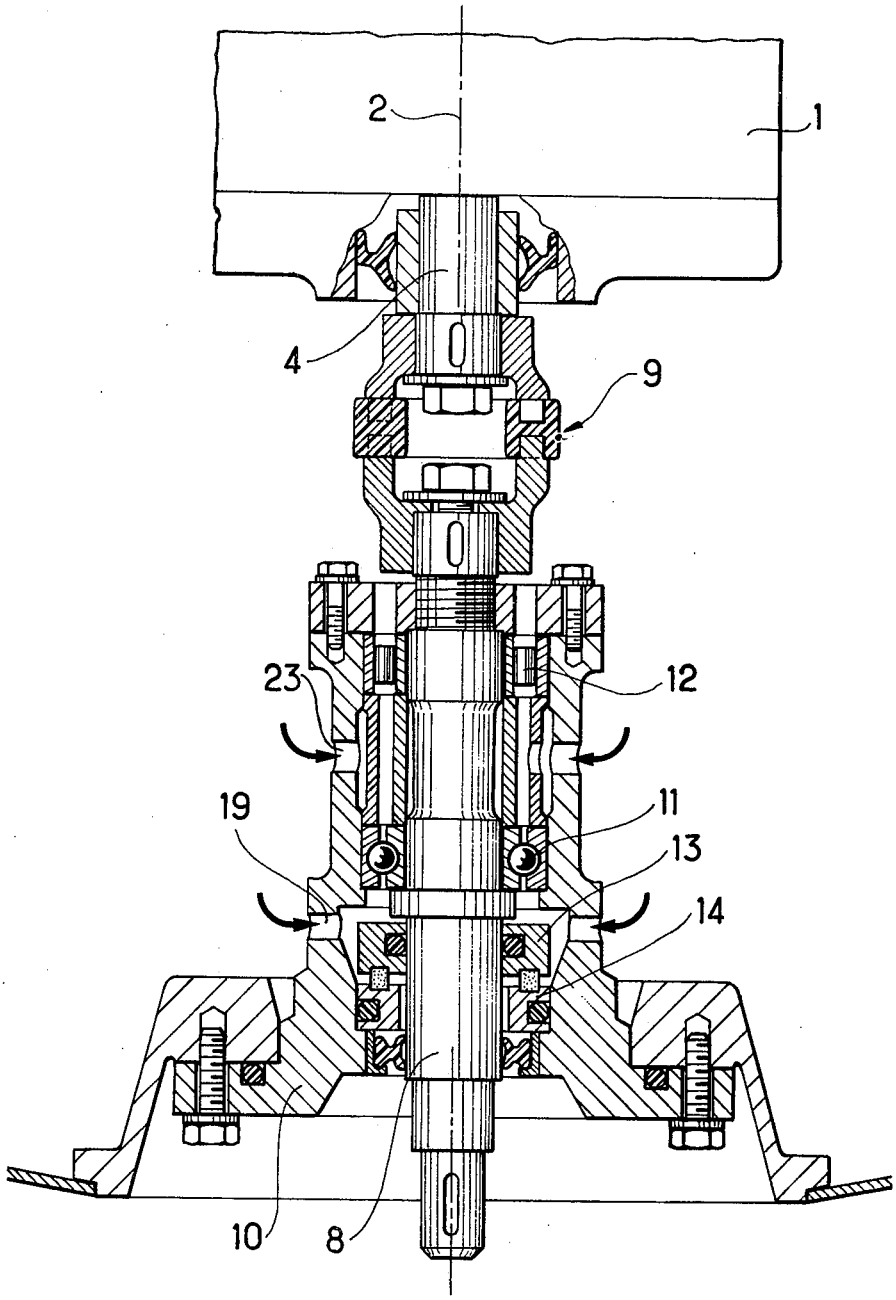
FIG. 2 is a sectional view of a portion of the assembly showing a detail of FIG. 1.

The assembly includes an engine 1 of the type which includes meshed screws with parallel axes 2 and 3. The engine includes an output shaft 4 and it is placed inside a sealed chamber 5, the output shaft 4 being disposed vertically towards the bottom.

The engine operates by means of the expansion of "Freon" which enters the engine through a pipe 6 and which leaves the engine through an outlet 7. The output shaft 4 of the engine is coupled to a transmission shaft 8 by means of a coupling 9 which allows some axial and radial play such as, for example, a resilient coupling e.g. a toothed metal coupling or a resilient strip coupling. The transmission shaft 8 is supported by a bushing 10 which is integral with the chamber 5 and which has two bearings: a lower bearing 11 which fixes the axial position of the transmission shaft, a ball bearing for example, and an upper bearing 12 which allows some axial freedom to the transmission shaft 8, such as a roller bearing for example.

A rotating seal ring 13 is installed on the transmission shaft 8 in the vicinity of the lower bearing 11 and co-operates with a fixed seal ring 14 installed in the fixed bushing 10. This is, for example, a magnetic pressure graphite on stellite seal system.

The transmission shaft assembly is immersed in a lubricant 15 which is used firstly to lubricate the seal system 13 and 14 and secondly to lubricate the two screw engine 1; a pump 16, driven by the engine and immersed in the lubricant 15, conveys the lubricant through a pipe 17 towards a lubricant injection orifice 18 in the engine fluid inlet pipe 6 at the point where it is admitted to the engine. The lubricant, for example oil, leaves with the "Freon" through the outlet 7. The bushing 10 includes orifices 19 to lubricate the seal system 13 and 14. These orifices 19 are situated at a higher level than that of the bottom 20 of the chamber 5 such that condensed "Freon" will gather on the bottom and will not be able to reach the orifices 19 and thus go towards the seals 13 and 14 to leave the chamber. In order to evaporate the Freon dissolved in oil and possibly condensed at the bottom of the chamber, the oil is heated by means of hot water under pressure flowing in a pipe 21 which enters the chamber through a flanged joint 22 and which leaves it through another flanged joint not shown.

Other orifices 23 are also provided above the orifices 19 to lubricate the bearings. It is thus seen that the "Freon" which can leave via the output shaft 4 of the engine is trapped in the chamber 5; only the part of the "Freon" which is dissolved in the oil 15 can escape in very small quantities via the seals 13 and 15, this quantity being negligible particularly as the heating of the oil by means of the heating pipe 21 makes the quantity of "Freon" dissolved in the oil very small. It follows consequently, that the seals are well lubricated since they are in contact only with the oil.

Since the transmission shaft 8 is not subjected to bending, due to the resilient coupling 9, it also allows the seals 13 and 14 to operate in good conditions and the leakage path of the seals which corresponds to the circumference of the transmission shaft at the place where the seals are located is shorter than that of the output of the drive shaft 4, since the transmission shaft is designed for the value of the maximum engine torque but without any bending forces.

Since the "Freon" necessarily leaks via the output shaft 4 of the engine and enters the chamber 1, it is not necessary to connect the exhaust outlet 7 of the engine by a pipe towards the outside of the chamber, but on the contrary, advantage is taken of this situation to dispose a number of auxiliary devices inside the machine, such as, for example, a pump 24, used for conveying the "Freon" from the condenser, not shown, situated outside the chamber towards the boiler, also not shown, situated outside the chamber, a primary separation filter 25 for separating the oil from the "Freon" vapour and a secondary separation filter 26 situated inside a secondary chamber 27.

The exhaust vapour which contains a mixture of "Freon" and of oil passes firstly through the primary filter 25 and loses a part of the oil in the filter, then passes through the secondary chamber 27 via its top lateral edges, passes through the secondary filter 26 and abandons the remainder of the oil contained in the "Freon" in the filter and lastly, the "Freon" leaves the chamber through a sealed flange joint 28. A pipe, not shown, conveys the "Freon" from the joint 28 to the condenser, not shown. From the condenser, the fluid is brought back towards the pump via a pipe 29 whose part inside the chamber 5 has been shown. The oil returns by gravity through pipes 33 and 34 towards the bottom of the chamber 5.

A port 30 is provided which allows the oil level to be checked. The chamber includes support legs 31. An oil drainage or bleeding device 32 is provided at the bottom of the chamber.

By way of an example, the following numerical data is given: a two screw engine providing 6 kW to its shaft, operating on "Freon 11", has "Freon" at its inlet at a pressure of 12 bars and a temperature of 140° C., at its exhaust at a pressure of 1.8 bars and a temperature of 58° C., turns at revolutions: 4,600 r.p.m. and uses about 200 kg of "Freon".

Of course, this data is given only by way of example, as is the type of the working fluid, lubricating fluid and lubricant heating fluid, and some components described could be replaced by equivalent elements which perform the same technical function and provide the same result.

What is claimed is:

1. A device for preventing leakages of a working fluid from an engine which operates by means of the internal energy of the fluid and which operates in a closed cycle, the improvement wherein: the engine is supported inside a fixed and sealed chamber with its output shaft extending vertically downwards, a transmission shaft is aligned with said engine output shaft and coupled to said output shaft by means of a coupling allowing some radial and axial play, said transmission shaft passing through said chamber, a lower bearing axially fixing the transmission shaft and an upper bearing radially fixing said transmission shaft but allowing a free axial expansion thereof, a rotating seal ring in the vicinity of the lower bearing which fixes the shaft axially and cooperating with a fixed seal ring integral with said chamber, said seals being lubricated by means of a lubricant contained in the lower part of said chamber, lubricant supply orifices for said seals being provided in a support bushing for the seals and the bearings, at a higher level than that of the bottom of the chamber, and heating means for keeping the lubricant at a temperature causing the evaporation of said fluid which is contained in the lubricant.

2. A device according to claim 1, wherein the engine is a two screw engine, the screws having parallel axes and meshing together.

* * * * *